United States Patent [19]

Blum

[11] Patent Number: 4,529,033

[45] Date of Patent: Jul. 16, 1985

[54] HOT TUB HEATING SYSTEM

[76] Inventor: Stephen E. Blum, 8 Ledgewood Rd., Framingham, Mass. 01701

[21] Appl. No.: 574,343

[22] Filed: Jan. 27, 1984

[51] Int. Cl.[3] ..... F24H 3/00

[52] U.S. Cl. ..... 165/39; 165/47; 165/70; 237/1 R; 4/493; 126/374

[58] Field of Search ..... 126/416, 415, 362; 237/1 R; 4/493; 165/39, 70

[56] References Cited

U.S. PATENT DOCUMENTS 4,381,031 4/1983 Whitaker et al. ..... 165/39
4,402,359 9/1983 Carnavos et al. ..... 165/70

FOREIGN PATENT DOCUMENTS 126749 9/1980 Japan ..... 126/416

*Primary Examiner*—Henry Bennett

*Attorney, Agent, or Firm*—Wolf, Greenfield & Sacks

[57] ABSTRACT

A system for heating a hot tub or spa from an existing potable hot water supply is disclosed. The system uses a heat exchanger element which isolates the potable hot water supply from the hot tub water. A failure in the heat exchanger does not cause intermixing of the potable and hot tub water and thus the system meets local plumbing codes. The heat exchanger consists of a center pipe surrounded by two concentric tubular sleeves. The center pipe carries the potable hot water from the hot water system. Surrounding the center pipe is an annular sleeve which has a plurality of longitudinal slots located on the inner surface adjacent to the center pipe. The sleeve is, in turn, surrounded by an outer jacket through which the hot tub water flows. A failure in the center pipe or the sleeve causes water to flow out through the slots, alerting the owner of the heating system that a failure has occurred.

10 Claims, 2 Drawing Figures

HOT TUB HEATING SYSTEM

FIELD OF THE INVENTION

This invention relates to heating systems for heating hot tubs and other pools and, in particular, to systems which utilize heat from existing hot water supplies.

BACKGROUND OF THE INVENTION

One obvious concern with a hot tub or heated swimming pool is heating of the water prior to use. If a conventional electrical or fossil-fuel fired heater is used, the cost of keeping the hot tub continuously heated can become exhorbitant. Alternatively, the tub may be kept cold or at a low temerature during times when it is not in use. However, the tub must then be heated to operating temperature before the owner can use it and the warm-up time can be considerable if the tub is of large capacity.

In order to save energy, prior art heating devices have been developed which utilize heat from a hot water source that is continuously kept at an elevated temperature for other reasons, such as furnace burners or home water heaters. An energy savings can be realized because, operating alone, these heat sources are typically not more than approximately 60 percent efficient. The low efficiency is mainly due to heat losses caused by maintaining the water hot for immediate use.

To recapture some of the heat which would ordinarily be lost, some prior art hot tub heating devices circulate the hot water from a space heating or hot water system through sealed heating coils inside the hot tub or pool by means of a pump controlled by a thermostat.

One problem with these prior art systems is that when they are used with a potable hot water heating system they generally do not meet existing plumbing codes. The problem with plumbing codes occurs because a failure in the heat exchanger element located in the hot tub can cause an intermixing of potable water and hot tub water resulting in the potable water becoming contaminated.

Another problem is that conventional heating systems utilize the existing hot tub water circulation system to circulate water through the heater. Generally, known heaters are controlled by a low-pressure safety switch which turns off the heater during a low water pressure condition to prevent damage to the heater and to prevent a fire from an overheated heater. During the normal operation of a hot tub, the conventional filtration system slowly becomes filled. If the user allows the filter to become clogged, thereby reducing the circulation water pressure, then often the heater will shut off resulting in the user placing a service call.

It is, therefore, an object of the present invention to provide a hot tub heating system which meets plumbing codes.

It is another object of the present invention to provide a hot tub heating system which can utilize heat from an existing potable hot water supply and prevent intermixing of the hot tub water and the potable water upon a failure of the heat exchanger.

It is yet another object of the present invention to provide a hot tub heating system which is simple and easy to install.

It is yet another object of the present invention to provide a hot tub heating system which can be easily retro-fitted to existing space heating or potable hot water supplies.

It is still another object of the present invention to provide a hot water heating system which utilizes readily available parts and components.

It is still a further object of the present invention to provide a hot water heating system which requires no special electrical or gas connections and which does not require an exhaust gas flue or stack.

It is another object of the present invention to provide a hot water heating system which does not shut off if the hot tub filter becomes clogged.

SUMMARY OF THE INVENTION

The foregoing objects are achieved and the foregoing objects are solved in one illustrative embodiment of the present invention in which an isolating heat exchanger is used to transfer heat from the existing hot water supply to the hot tub while maintaining isolation between the potable hot water and the hot tub water. In particular, the isolating heat exchanger consists of three concentric annular pipes. The innermost pipe carries the potable hot water and is surrounded by a slotted sleeve which is in turn surrounded by a outer jacket containing the hot tub water. A failure in the inner pipe or the slotted sleeve causes water to leak out through the slots informing the owner that a failure has occurred. The inventive heating system utilizes a heating water flow loop which is separate from the normal filtration loop and thus is not subject to failure if the hot tub filter becomes clogged.

DETAILED DESCRIPTION OF THE PREFERRED EMBODIMENT

Figure 1:
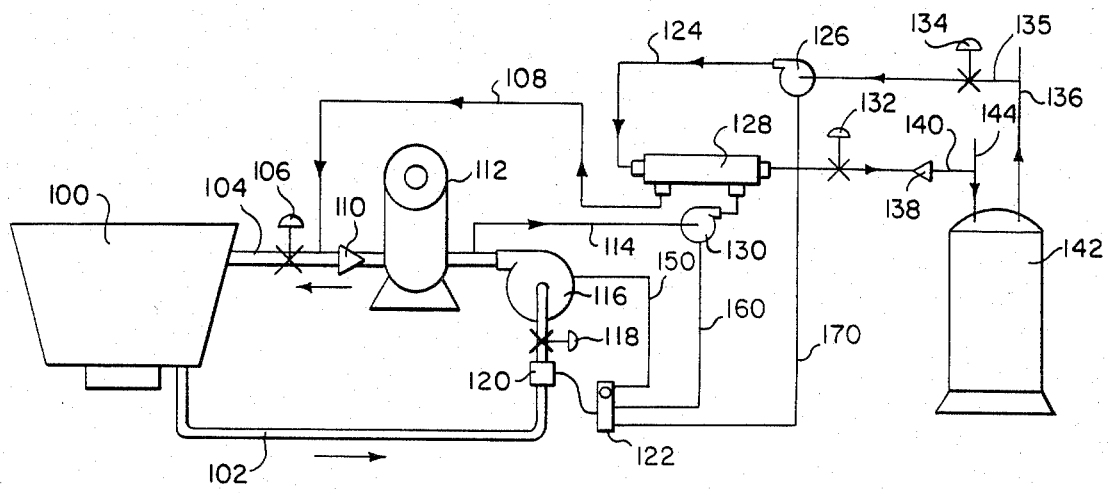
FIG. 1 of the drawing is a schematic view of the hot tub heating system operating with a potable hot water supply system.

A schematic diagram of an illustrative hot tub heating system using a potable hot water heating supply as a heat source is shown in FIG. 1. In accordance with conventional practice, a typical hot tub water circulation and filtering system is shown on the left side of the figure. This circulation system consists of hot tub 100 from which water is withdrawn via supply pipe 102. The supply water passes through aquastat sensor 120 which operates motor control 122. Although the aquastat is shown located in the supply pipe, it is also possible to locate the aquastat inside the hot tub so that it can directly monitor the actual hot tub temperature. From the aquastat, the supply water passes through a shut-off valve 118 and hot tub filter pump 116.

Pump 116 pumps water through filter 112 and, via shut-off valve 106 and return pipe 104, back to hot tub 100 to supply the tub water circulation jets. Conventionally, it is a high-pressure pump which is capable of pumping to a head of approximately 60 feet. Also, in a prior art system, pump 116 would also pump water through a conventional heater (not shown) which is eliminated by the inventive heating system.

When the hot tub system is used with the inventive heating system, an additional flow loop is added to connect the system to heat exchanger 128. In accordance with the invention, while the system is operating in the heating mode, the supply water for the heating system and the returning heated water bypasses filter 112 so that, if the filter becomes clogged, the heating system is unaffected.

In particular, a connection pipe 114 connects the hot tub water circulation system to the input of circulator 130. Circulator 130 is controlled by aquastat 120 and motor control 122 and is a low-pressure pump capable of pumping to a head of approximately 3 feet with negligible output pressure. The output of circulator 130 connects to the outer jacket of heat exchanger 128. The water heated in heat exchanger 128 travels, via return connection pipe 108 to the input of shutoff valve 106 and from there to the hot tub 100 by means of return pipe 104. Check valve 110 forces the heated water in pipe 108 into tub 100, thereby isolating feed lines 102 and 114 from return lines 104 and 108 to prevent the heated water from circulating through pipes 108 and 114 and filter 112 and never entering tub 100. Valve 110 is a spring-loaded valve which opens under the output force of pump 116 (generally 10 PSI or more) when the filtering system is in operation.

The location of the connections of pipes 108 and 114 to the hot tub water circulation system is important for proper operation of the system. In particular, both pipes must be connected either to the return side or the discharge side of pump 116. Otherwise a pressure differential will develop between pipes 108 and 114 and force tub water through the heat exchanger when the filtering system is in operation resulting in a reverse flow.

Located on the right side of the figure is a conventional and existing potable hot water heater 142 which may be either electric or fossil-fuel fired. Cooled water enters the system through pipe 144 and hot water leaves through pipe 136. Hot tub 100 and water heater 142 are connected together via heat exchanger 128 which will be described in more detail hereinafter.

In particular, the potable hot water from the heater exit pipe 136 passes through pipe 135 and shut-off valve 134 to circulator 126. Circulator 126 pumps the hot water, via line 124, to heat exchanger 128 where heat from the potable hot water system is passed to the hot tub water circulation system. The potable hot water then returns, via shut-off valve 132 and check valve 138, to the cold water side of the hot water heater. Check valve 138 prevents coupling of the hot and cold water lines through the hot tub heating system. Although valve 138 is shown located on pipe 140 it may be located anywhere on pipes 136 or 140 either before or after the valves. Circulator pump 126 is similar in construction to pump 130 and is controlled by motor control 122.

Figure 2:
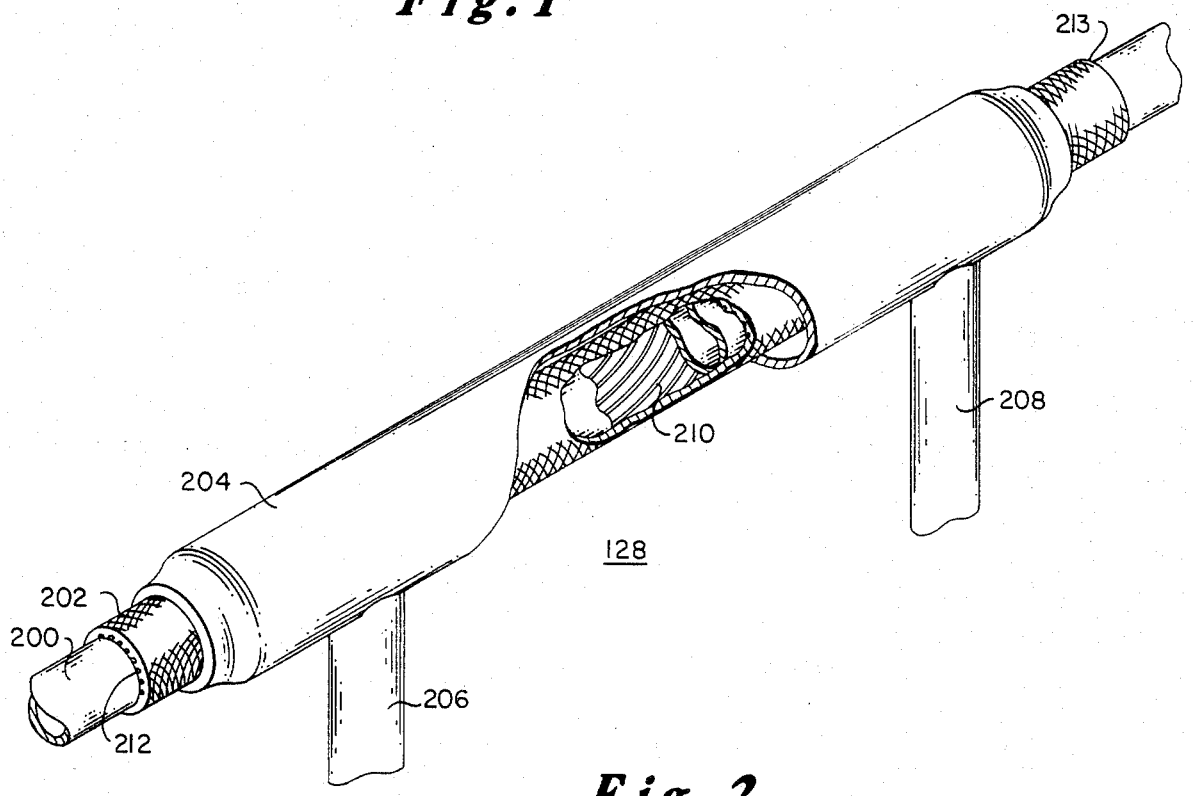
FIG. 2 is a sectional view of the three section heat exchanger.

Details of heat exchanger 128 are shown in FIG. 2. The exchanger consists of an inner pipe 200 through which the hot water from the potable hot water heating system passes. Tube 200 may have a smooth inner surface or may have a conventional ribbed inner surface to facilitate heat transfer. Tube 200 is surrounded by a slotted sleeve 202. In particular, sleeve 202 has a plurality of slots 210 which extend longitudinally to each end 212, 213 of the sleeve. The slots may be straight or spiraled. The sleeve may also have a knurled or fluted outer surface to facilitate heat transfer. The sleeve is in turn surrounded by a water jacket 204 which is connected to the hot tub system by means of connection nipples 206 and 208. A failure in either inner tube 200 or sleeve 202 causes water to flow through slots 210 out the ends 212, 213 of the heat exchanger unit. Thus, the owner will be alerted to the fact that a break has occurred.

The heat exchanger may be made from copper, copper-nickel alloy, stainless steel or brass or other suitable materials which are resistant to known changes in water chemistry of the hot tub. A heat exchanger which is suitable for the illustrative embodiment is a heat exchanger manufactured by the Forge-Fin Division of the Noranda Corporation located in Newtown, Conn. The length and diameter of the heat exchanger will depend on the size and the amount of heat necessary to heat the hot tub and can be determined in accordance with well-known methods.

Although only one embodiment of the invention is shown there are modifications which will be immediately apparent to those skilled in the art and which are within the spirit and scope of the invention. For example, it is possible for the potable water supply to pass through the outer jacket and the hot tub water to pass through the inner pipe.

What is claimed is:

1. A heating system for a hot tub and a pool for use with a potable hot water heating system having a cold water entry pipe and a hot water exit pipe, said heating system comprising;

a heat exchanger unit comprising;
- an inner pipe,
- an annular sleeve enclosing said inner pipe, said sleeve having a plurality of slots spaced around the inside diameter thereof and extending longitudinally along the entire length of said sleeve, and
- an outer jacket enclosing said sleeve said outer jacket having a first and a second connection nipple;

a first water flow path for filtering water from said hot tub and pool, said first path comprising;
- a supply pipe connected to said hot tub and pool,
- an aquastat connected to said supply pipe,
- a first shutoff valve connected to said aquastat,
- a first circulator pump connected to said aquastat,
- a filter connected to said first circulator pump,
- a first check valve connected to said filter, said first check valve preventing water heated in said heat exchanger from flowing back through said filter,
- a second shutoff valve, connected to said check valve
- and a return pipe connected from said second shutoff valve to said hot tub and pool;

a second water flow path for circulating water from said hot tub and pool to said heat exchanger, said second water flow path comprising,
- a connection pipe connected between said first circulator and said filter,
- a second circulator connected to said connection pipe and to said first connection nipple, and
- a return connection pipe connected to said second connection nipple and to said first water flow loop between said first check valve and said second shutoff valve;

a third water flow loop for circulating potable water from said potable water heating system to said heat exchanger, said third water flow loop comprising,
- a third shutoff valve connected to said hot water exit pipe of said potable hot water heating system, a third circulator connected to said third shutoff valve and to said inner pipe of said heat exchanger, a fourth shutoff valve connected to said inner pipe of said heat exchanger, a second check valve connected between said fourth shutoff valve and said cold water entry pipe of said potable water heating system, said second check valve inhibiting the flow of potable water from said cold water entry pipe to said potable hot water heating system when said third circulator is turned off.

2. A heating system according to claim 1 wherein said heat exchanger is made of copper.

3. A heating system according to claim 1 wherein said heat exchanger is made of brass.

4. A heating system according to claim 1 wherein said second circulator is controlled by said aquastat so as to operate said second circulating means when the temperature of the hot tub water falls below a predetermined temperature.

5. A heating system according to claim 4 wherein said sleeve is knurled to promote heat exchange.

6. A heating system according to claim 4 wherein said sleeve is fluted to promote heat exchange.

7. A heating system for a hot tub and a pool for use with a potable hot water heating system, said heating system comprising;

a heat exchanger unit comprising;

an inner pipe, an annular sleeve enclosing said inner pipe, said sleeve having a plurality of slots spaced around the inside diameter thereof and extending longitudinally along the entire length of said sleeve, and an outer jacket enclosing said sleeve;

a first water flow loop for filtering water from said hot tub and pool, said first loop including a filter and first means for circulating said hot tub and pool water through said filter;

a second water flow loop for circulating water from said hot tub and pool to said heat exchanger, said second path being connected to said first path across said filter and having second means for circulating said hot tub and pool water through said heat exchanger outer jacket;

a third water flow loop for circulating potable water from said potable water heating system to said heat exchanger, said third water flow loop having third means for circulating said potable hot water through said third loop and said heat exchanger inner pipe; and an aquastat located in said first flow loop and wherein said third circulating means is controlled by said aquastat so as to operate said third circulating means when the temperature of the hot tub water falls below a predetermined temperature.

8. A heating system for a hot tub and a pool for use with a potable hot water heating system, said heating system comprising;

a heat exchanger unit comprising;

an inner pipe, an annular sleeve enclosing said inner pipe, said sleeve having a plurality of slots spaced around the inside diameter thereof and extending longitudinally along the entire length of said sleeve, and an outer jacket enclosing said sleeve;

a first water flow loop for filtering water from said hot tub and pool, said first loop including a filter water through said filter;

a second water flow loop for circulating water from said hot tub and pool to said heat exchanger, said second path being connected to said first path across said filter and having second means for circulating said hot tub and pool water through said heat exchanger inner pipe;

a third water flow loop for circulating potable water from said potable water heating system to said heat exchanger, said third water flow loop having third means for circulating said potable hot water through said third loop and said heat exchanger outer jacket; and an aquastat located in said first flow loop and wherein said third circulating means is controlled by said aquastat so as to operate said third circulating means when the temperature of the hot tub water falls below a predetermined temperature.

9. A heating system according to claim 7 wherein said second circulating means is controlled by said aquastat so as to operate said second circulating means when the temperature of the hot tub water falls below a predetermined temperature.

10. A heating system according to claim 9 wherein first water flow loop includes a check valve to prevent water heated in said heat exchanger from flowing back through said filter.

* * * * *